US005445910A

United States Patent [19]

Ishikawa et al.

[11] Patent Number: 5,445,910

[45] Date of Patent: Aug. 29, 1995

[54] DEVELOPER FOR DEVELOPING ELECTROSTATIC IMAGE COMPRISING A TONER CONTAINING COLORANT PARTICLES HAVING ORGANIC PARTICLES EXTERNALLY ADDED THERETO

[75] Inventors: Michiaki Ishikawa; Keiko Ogawa; Meizo Shirose; Hiroyuki Takagiwa, all of Hachioji, Japan

[73] Assignee: Konica Corporation, Tokyo, Japan

[21] Appl. No.: 200,697

[22] Filed: Feb. 23, 1994

[30] Foreign Application Priority Data

Feb. 25, 1993 [JP] Japan ..... 5-059302

[51] Int. Cl.[6] ..... G03G 9/083; G03G 9/09

[52] U.S. Cl. ..... 430/106.6; 430/111

[58] Field of Search ..... 430/106, 109, 110, 106.6, 430/111

[56] References Cited

U.S. PATENT DOCUMENTS 5,312,710 5/1994 Tomita et al. ..... 430/109

5,328,794 7/1994 Kazuo et al. ..... 430/109

*Primary Examiner*—John Goodrow

*Attorney, Agent, or Firm*—Finnegan, Henderson, Farabow, Garrett & Dunner

[57] ABSTRACT

Disclosed is a developer comprises a toner containing colorant particles and organic fine particles, wherein said organic fine-particles are a fluoro-containing acrylate homopolymer or the copolymers thereof, each having a cross-linking structure.

10 Claims, No Drawings

DEVELOPER FOR DEVELOPING ELECTROSTATIC IMAGE COMPRISING A TONER CONTAINING COLORANT PARTICLES HAVING ORGANIC PARTICLES EXTERNALLY ADDED THERETO

FIELD OF THE INVENTION

This invention relates to a developer comprising a toner containing colorant-particles and organic fine-particles.

BACKGROUND OF THE INVENTION

In an example of electrophotography, an electrostatic latent-image is formed on a photoconductive photoreceptor by charging the photoreceptor and then exposing it to light. The resulting electrostatic latent-image is developed with a developer so that a toner-image can be formed. Then, the resulting toner-image is transferred to an image-transfer material and the transferred image is then so fixed as to form a copied-image.

In such an image-forming process as in the above-described electrophotography, there raises such a problem as will be mentioned below.

(1) Environmental dependency of image-transfer characteristics

In an image-transfer step of an image-forming process, the image-transfer characteristics of the image-transfer process tend to depend greatly on the environment. Particularly when an image is formed under high-temperature and high-humidity conditions, an image-transfer ratio to an image-transfer material is relatively lower than in the case that an image is formed under the conditions of an ordinary temperature and an ordinary humidity, and an image-transfer unevenness may sometimes produced on a resulting copied-image, so that any satisfactory image-transfer characteristics cannot be enjoyed.

Because of the above-mentioned reasons, the charged amount of toner, that greatly influences image-transfer characteristics, cannot become satisfactory and an image-transfer material absorbs moisture and the surface of the image-transfer material is dew-condensed, so that an electric resistance on the surface of the image-transfer material is extremely lowered thereby and, especially, under the conditions of a high-temperature and a high-humidity.

(2) Environmental dependency of image-density

A copied-image density tends to depend greatly on the environment and, particularly, a humidity environment (or an moisture in the air) greatly influences image-densities.

For example, when a copied-image of a half-toned gray-chart is formed under the conditions of a high-temperature and a high-humidity, the image-density of a copied-image to be obtained is made higher than the original density, so that any fidelity image-density cannot be reproduced, because the charged amount thereof is lowered under the conditions of a high-temperature and a high-humidity, so that an over-development cannot be avoided.

On the other hand, from the viewpoints of the improvement of toner chargeability and the environmental safety of charging amount, the techniques for containing fluororesin particles in toner -Refer to Japanese Patent Open to Public Inspection (hereinafter referred to JP OPI Publication) Nos. 53-130036/1978, 62-75539/1987, 62-75553/1987 and 3-170946/1990.

According to these techniques, the environmental safety of charging amount can be attempted by making use of hydrophobic fluororesin particles and thereby the above-mentioned problems (1) and (2) can be solved to some extent.

However, the fluororesin particles applicable to the techniques described in the above-given patent specifications are comprised of a (co-)polymer having a non-cross-linked structure and containing fluorine atom at the principal chain thereof. The fluororesin particles comprising such a (co-)polymer as mentioned above are so soft that they are liable to be deformed. Therefore, when making use of a toner containing the fluororesin particles such as those mentioned above and images are formed repeatedly through a copying machine loaded with a toner recycle system or the like, the fluororesin particles are made adhered to and fused into a developing sleeve and/or a carrier so as to stain them. Resultingly, a white streak is produced on a copied image to be formed and the copying machine is stained inside by flying the toner therein.

In the techniques described in the above-given patent specifications, as mentioned above, the durability of the particles are shortened as a developer, so that a series of multicopied images cannot stably be formed.

When making use of a two-component type developer comprising toner and carrier, the above-mentioned problem (2) cannot satisfactorily be solved even when making use of the techniques described in the above-given patent specifications. To be more concrete, even if a hydrophobic resin is introduced only into toner, the environmental safety of an image-density cannot satisfactorily be achieved, because a charged amount of toner contained in a two-component type developer is a physical amount effective in an interaction between toner and carrier.

SUMMARY OF THE INVENTION

This invention was achieved by taking the above-mentioned circumstances into consideration.

It is, therefore, an object of the invention to provide an excellently durable developer capable of displaying excellent image-transfer characteristics and stably forming a series of multicopied images, even when the developer is applied for an image formation, even under the environmental conditions of a high-temperature and a high-humidity.

Another object of the invention is to further provide a developer excellent in the environmental safety of an image-density (or in a density reproduction stability) and capable of reproducing a fidelity image-density even under the environmental conditions of a high-temperature and a high-humidity.

DETAILED DESCRIPTION OF THE PREFERRED EMBODIMENT

A developer of the invention is characterized in a developer comprising a toner containing colorant particles and organic fine-particles, wherein the organic fine-particles has a cross-linked structure and comprises homopolymer or copolymer of the fluoro-containing acrylate, (hereinafter referred sometimes to a fluoro-containing acrylate (co-)polymer).

In a developer of the invention, it is preferable that the organic fine-particles thereof are to have a primary average particle-size within the range of 50 to 500 nm and a BET specific surface area within the range of 10 to 120 $m^2/g$.

The developers of the invention are also preferable that a resin-coated layer comprising a silicone resin contains a resin-coated carrier formed on the surface of magnetic particle.

Function (1) (i) Because the fluoro-containing acrylate (co-)polymer constituting an organic fine-particles and having a cross-linked structure is a hydrophobic resin, the charged amount of toner containing the organic fine-particles can hardly be affected by moisture. Therefore, the charged amount can be satisfactory without depending on any environment, so that excellent image-transfer characteristics can be displayed even under the conditions of a high-temperature and a high-humidity.

(ii) Because the fluoro-containing acrylate (co-)polymer constituting an organic fine-particles and having a cross-linked structure is a resin having a relatively low surface energy, a toner containing the organic fine-particles has a relatively weak physical adhesive power to a photoreceptor. From the above-mentioned viewpoint, the image-transfer characteristics thereof are excellent.

(iii) Because the fluoro-containing acrylate (co-)polymer constituting an organic fine-particles and having a cross-linked structure has fluorine atom at the side chain thereof, the (co-)polymer is extremely high in hardness and, because the (co)polymer has a cross-linked structure, it can hardly be deformed and, further, excellent in hardness as well. Therefore, the organic fine-particles cannot adhere to and stain a developing sleeve and a carrier, so that a series of multicopied images can stably be formed.

(2) The organic fine-particles are interposed between toner colorant particles and a photoreceptor and they are served as a spacer for regulating the distance between the colorant particles and the photoreceptor. Therefore, the distance between the colorant particles and the photoreceptor can be suitably set through the organic fine-particles by specifying the particle sizes of the organic fine-particles (or the primary average particle size and the BET specific surface area thereof) within a specific range and, from the above-mentioned viewpoint, the image-transfer characteristics can also be improved by making the electrostatically adhesive force moderated between the colorant particles and the photoreceptor.

(3) When making combination use of a resin-coated carrier formed of a resin coated-layer comprising a silicone resin, a hydrophobic resin is introduced into the carrier, so that the environmental safety of a charged amount can satisfactorily provided and the environmental safety of an image-density can also become excellent.

Now, the invention will be detailed below.

The developers of the invention are those comprising toner containing colorant particles and organic fine-particles.

Colorant particles

A colorant particle constituting toner shall not specially be limited, provided that they contain at least a binder resin and a colorant, but any conventionally known colorant particles may be used for.

Organic fine-particles

An organic fine-particle constituting toner are those serving as an external additive to toner.

A developer of the invention is characterized in that the organic fine-particles constituting the developer (1) has a cross-linked structure and (2) comprises homopolymer of the fluoro-containing acrylate or a copolymer thereof, that has a fluorine atom at the side chain thereof.

The term, "homopolymer of the fluoro-containing acrylate", herein stated means a polymer comprising only a fluoro-containing acrylate repeating unit (hereinafter sometimes referred to as an F-Ac repeating unit); and, the term, "a copolymer of the fluoro-containing acrylate", herein stated means a copolymer comprising the above-mentioned F-Ac repeating unit and the other repeating units.

The above-mentioned 'F-Ac repeating units' constituting each homopolymer of the fluoro-containing acrylate and a copolymer thereof include, for example, the repeating unit represented by the following Chemical Formula 1.

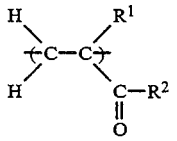

Formula 1 wherein $R^1$ represents a hydrogen atom or a methyl group; and $R^2$ represents a residual group from which the hydrogen atom is split off from the hydroxyl group of an alcohol compound containing a fluorine group substituted to at least one of the hydrogen atoms of the alkyl group.

In Formula 1, the examples of the compounds capable of forming a residual group represented by $R^2$ include, concretely; perfluoroalcohol alcohol having 1 to 18 carbon atoms; 1,1-dihydroperfluoroalcohol or trihydroperfluoroalcohol each represented by $CF_2X(CF_2)nCH_2OH$ (provided, in which n is an integer of 0 or 1 to 16 and X represents a hydrogen atom or a fluorine atom); tetrahydroperfluoroalcohol represented by $CF_3(CF_2)n(CH_2CH_2)(CF_2)_mOH$ (provided, in which is an integer of 0 or 1 to 15 and m is 0 or 1); and, besides the above, the examples thereof also include fluoroalcohol, fluorocetyl alcohol and N-fluoroalkylsulfonyl-N-alkylaminoalcohol. As for the concrete examples of each of the alcohols may also include those exemplified in JP OPI Publication No. 64-33562/1989.

In the F-Ac repeating units represented by the above-given Formula 1, the preferable residual groups among those represented by $R^2$ include, for example, those given below.

$-O(CH_2)_nC_mF_{2m+1}$ (in which n is an integer of 1 to 8 and m is an integer of 1 to 19)); and $-O(CH2)_p(CF2)_qH$ (in which p is an integer of 1 to 8, and q is an integer of 1 to 19);

Among them, the particularly preferable residual groups include, for example, those given below.

$-OCH_2CF_3$; $-OCH_2(CF_2)_2H$ and $-OCH_2CF_2CF_3$

The fluoro-containing acrylate homopolymer constituting organic fine-particles may also be comprised of not less than two kinds of F-Ac repeating units.

The fluoro-containing acrylate copolymer is comprised of the above-mentioned F-Ac repeating unit and the other repeating unit.

As for the other repeating units includes for example, a repeating unit introduced from such a monomer as those of an aliphatic olefin, halogenated aliphatic olefin, conjugated diene aliphatic olefin, aromatic vinyl type compound, nitrogen-containing vinyl type compound or (meth)acrylic alkyl ester. A fluoro-containing acrylate copolymer can be constituted by making combination use of not less than two of these repeating units.

The concrete examples of the monomers applicable to introduce the other repeating units include the monomers given in JP OPI Publication No. 64-33562/1989. Among these monomers, styrene, methylstyrene and (metha)acrylic acid alkyl ester are particularly preferable from the viewpoints of controlling a charging amount and a layer-casting property.

In a copolymer of the fluoro-containing acrylate, the F-Ac repeating unit containing proportion is preferably not less than 55% by weight, from the viewpoints of an excellent image-transfer property and an environmental safety of an image-density.

The above-mentioned fluoro-containing acrylate (co-)polymers have a cross-linked structure. When preparing an organic fine-particles, a cross-linking agent is to be used.

As for the cross-linking agents, polyvalent alcohol methacrylates such as ethyl glycol dimethacrylate, diethylene glycol dimethacrylate, triethylene glycol dimethacrylate, tetraethylene glycol dimethacrylate, neopentyl glycol dimethacrylate, dipropylene glycol dimethacrylate, trimethylol propane trimethacrylate, trimethylol ethane trimethacrylate and pentaerythritol tetracrylate; a polyfunctional vinyl benzenes such as divinyl benzene; and other compounds. They may also be used independently or in combination.

Such a cross-linking agents may be used preferably in a proportion within the range of 0.1 to 30% by weight to the whole monomer used therein.

As described above, the organic fine-particles constituting a developer of the invention have both of the hydrophobic property and low surface-energy property, which are the natures of a fluoro-containing acrylate (co-)polymer. Therefore, a developer of the invention comprising toner containing the above-mentioned organic fine-particles can display the excellent image-transfer characteristics.

The fluoro-containing acrylate (co-)polymers constituting the above-mentioned organic fine-particles are extremely high in hardness even if they have each a fluorine atom at the side chain thereof and, in addition, they are more excellent in hardness and they can further hardly be deformed, because they have a cross-linked structure. Besides the above, they are high in glass transition point as compared to that of other kinds of fluororesins, so that a fusion to any carrier can hardly be produced.

Accordingly, even when making use of a developer of the invention comprising toner containing the above-mentioned organic fine-particles and repeatedly forming a series of multicopied images, the organic fine-particles cannot adhere to nor fused into any developing sleeve or carrier so as not to stain the sleeve and carrier. Therefore, there does not raise such a trouble that a white streaks may be produced on a resulting copied image, and/or that a copying machine may be stained inside by flying toner.

The organic fine-particles constituting a developer of the invention are to have a primary average particle size, which means a number average particle size, within the range of, preferably, 50 to 500 nm and, more preferably, 50 to 300 nm.

The organic fine-particles are to have a BET specific surface area within the range of, preferably, 10 to 120 $m^2/g$.

When the particle sizes of organic fine-particles are specified as mentioned above, a distance between colorant particles and a photoreceptor can be suitable through the organic fine-particles serving as an external additive to toner. Thereby the distance between the colorant particles and the photoreceptor can be suitable, so that the image-transfer characteristics can further be improved by making the electrostatical adhesive-force moderated between the colorant particles and the photoreceptor.

When the primary average particle size of organic fine-particles is smaller than 50 nm, or when a BET specific surface area exceeds 120 $m^2/g$, not only the electrostatical adhesive-force cannot be moderated, but also the image-transfer characteristic improvements cannot satisfactorily be achieved.

On the other hand, when the primary average particle size of organic fine-particles exceeds 500 nm, or when a BET specific surface area is smaller than 10 $m^2/g$, there may be some instances where the organic fine-particles may be freed from the colorant particles without satisfactorily being fixed to the colorant particles and, on the contrary, the toner charging property may be spoiled.

The organic fine-particles are preferable to have a spherical shape. When making use of spherical-shaped organic fine-particles, the toner area coming into contact with a photoreceptor can be smaller, so that the image-transfer characteristics can more be improved.

The organic fine-particles constituting the invention can be prepared in any conventionally known processes. For preparing spherical-shaped organic fine-particles, an emulsion-polymerization process, a soap-free emulsion polymerization process, a suspension polymerization process and so forth may be used. The organic fine-particles may also be prepared in such a manner that a polymer is prepared in a variety of the above-mentioned polymerization processes, a solution polymerization process, a bulk polymerization process or the like and the resulting polymer is dissolved in a solvent. Thereafter, the dissolved polymer is granulated in a spray-dry process, so that the organic fine-particles can be prepared. Among the above-mentioned processes, a soap-free emulsion polymerization process is particularly preferable from the viewpoints that the particle sizes and configuration thereof can readily be controlled and that the humidity dependence of a charging amount is relatively little.

The organic fine-particles are to be added as an external additive to colorant particles so as to constitute a toner. The amount of the organic fine-particles to be added may be varied according to the particle sizes of colorant particles used therein. However, it is preferable that the organic fine-particles may be added in an amount, for example, within the order of 1 to 10% by weight to the colorant having a particle size within the range of, for example, 4 to 10 $\mu m$.

To a toner for constituting a developer of the invention, any other external additive than the organic fine-particles may also be added. The external additives such as mentioned above shall not specially be limited, but, for example, a fluidity improving agent such as silica and titanium oxide may preferably be used.

Carrier

The developers of the invention may be used in the form of a single component type developer consisting only a toner and may also be used in the form of a two-component type developer comprising a toner and a carrier.

When making use of a developer of the invention in the form of a two-component type developer, the carrier thereof shall not specially be limited, but, from the viewpoint of the environmental safety of an image-density (or the density reproduction safety), the carrier is preferable to be a resin-coated carrier formed of a resin-coated layer comprising silicone resin on the surface of each magnetic particle.

In the magnetic particles constituting the above-mentioned resin-coated carrier, iron, ferrites such as Cu—Zn ferrite and Cu—Zn—Mg ferrite and magnetite, for example, can be used as a core particle of the magnetic particles.

The silicone resins for constituting a resin-coated layer shall not specially be limited. However, for example, an ordinary temperature-setting reaction type silicone resin such as represented by the following Formula 2 may be used preferably.

Formula 2

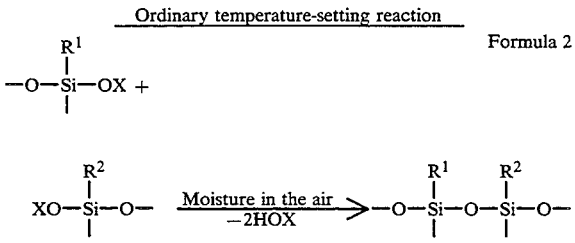

wherein OX represents a hydroxyl group, an alkoxy group, a ketoxime group, an acetoxy group or an aminoxy group; and $R^1$ and $R^2$ represent each a lower alkyl group having 1 to 6 carbon atoms.

As for such a room temperature-setting reaction type silicone resins as mentioned above, those having a methyl group as the substituent thereof. In a coated layer prepared of a room temperature-setting reaction type silicone resin having a methyl group as the substituent thereof, the resulting carriers can be minute in structure and excellent in water-repellency and moisture-resistance.

When making use of a room temperature-hardening reaction type silicone resin as a silicone resin capable of forming the resin-coated layer of a carrier, the carrier can readily be prepared, because that type of silicone resin is not necessary to be heated up particularly at a high temperature so as to thermally set it.

A room temperature-hardening reaction type silicone resin is a silicone resin that can be set at a temperature within the range of the order of 20° to 25° C. or at a slightly higher than within the above-mentioned range, each under an ordinary atmosphere. and that is not necessary to be heated at a temperature exceeding 100° C. for hardening it up.

As for a silicone resin applicable to form the resin-coated layer of a carrier, the silicone resins such as those mentioned above may be used independently or in combination, or a mixture of the silicone resins such as those mentioned above and other resins may also be used. The other resins mentioned above include, preferably, those having a high compatibility to silicone resins. The above-mentioned other resins include, for example, acryl resin, styrene resin, epoxy resin, urethane resin, polyamide resin, polyester resin, acetar resin, polycarbonate resin, phenol resin, vinyl chloride resin, vinyl acetate resin, cellulose resin, polyolefin resin, the copolymer resins thereof and a compounded resin.

The processes for forming a resin-coated layer comprising a silicone resin on the surfaces of magnetic particles include, for example, the following process: A resin-coating solution is prepared by dissolving a silicone resin in an organic solvent and the resulting resin-coating solution is coated on the surfaces of the core particles of a carrier. Then, the solvent is removed by heating and drying the coated core particles, so that the carrier can be set. The resin-coating solution coating processes include, for example, a dip-coating process, a spray-coating process and a fluidized pellet-coating process. However, there is no special limitation thereto.

As for the other means, a resin-coated carrier can also be prepared in the so-called dry process in which the fine particles of silicone resin are electrostatically deposited on the surfaces of carrier core particles and are then fixed thermally or mechanically.

As described above, when making combination use of a resin-coated carrier formed of a resin-coated layer comprising silicone resin, a hydrophobic resin is introduced into not only a toner but also a carrier. Therefore, the environmental safety of the toner charging amount can satisfactorily be secured and, as is obvious from the examples given below, the environmental safety of an image-density can also be excellent. Further, in the case of forming a copied image under the conditions of a high temperature and a high humidity, an over-development can be prevented so that a fidelity image-density can be reproduced.

EXAMPLES

Some examples of the invention will be detailed below. However, the invention shall not be limited to the following embodiments. In the following descriptions, the terms, "a part" and "parts", will be indicated herein by "a part by weight" and "parts by weight", respectively.

Each of the primary average particle sizes and BET specific surface areas of organic fine-particles was measured in the following methods.

Primary Average Particle Size

A primary average particle size which means a number average particle size, was determined by measuring an emulsified solution obtained when completing the emulsion-polymerization thereof through a particle-size distribution analyzer 'Model ELS-800' (manufactured by Ohtsuka Electronic Co.).

BET Specific Surface Area

The measurements thereof were made through a BET specific surface area measurement apparatus 'Flow Sorb II 2300 ' (manufactured by Shimazu Seisaku-sho Co.).

<EXAMPLE 1>

Preparation of Organic Fine-particle

A soap-free emulsion polymerization was carried out by making use of a monomer mixture comprising 95% by weight of monomer component consisting of 60 parts of 1,1,1-trifluoroethyl methacrylate (that was a fluoro-containing acrylate monomer) and 40 parts of methyl methacrylate (that was a copolymerizable monomer) and 5% by weight of divinyl benzene. The resulting emulsified solution was filtrated through a liltrating apparatus, so that a polymer could be prepared. The resulting polymer was washed and was then dried by a spray-drier, so that organic fine-particle A having a primary average particle-size of 90nm and a BET specific surface area of 106 $m^2/g$.

Preparation of Toner

After preliminarily mixing 100 parts of polyester resin, 'UXK-120P' (manufactured by Kao Corp.) and 10 parts of carbon black, 'Mogal L' (manufactured by Cabot Co.), the resulting mixture was kneaded, pulverized and classified, so that colorant particles having an average particle-size of 8.5 μm.

To the resulting colorant particles, 2.0% by weight of organic fine-particles A were added and, then, 1.0% by weight of hydrophobic-treated silica, ° Aerosil R 805', (manufactured by Japan Aerosil Co.) was added. Thereafter, the resulting mixture was mixed up by making use of a Henscheil mixer, so that toner was prepared.

Preparation of Carrier

Both of 100 parts of core-member particles (which were Cu-Zn ferrite particles having an average particle-size of 80 μm) and 3 parts of styrene-acryl resin were put in a horizontal rotary-blade type mixing machine. After mixing and stirring them at 20° C. for 15 minutes under the condition that the revolutions per second of the horizontal rotary-blades could be 10 m/second, the resulting mixture was heated up to 100° C. and was then stirred for 40 minutes, so that resin-coated carrier could be prepared.

Preparation of Developer

The resulting toner and carrier were mixed up in such a proportion that the toner concentration could be 4% by weight, so that developer 1 of the invention was prepared.

<Example 2>

Organic fine-particle B having a primary average particle-size of 120 nm and a BET specific surface area of 55 $m^2/g$ was prepared in the same manner as in Example 1, except that a monomer mixture comprising 90% by weight of monomer component consisting of 50 parts of 1,1,1-trihydroperfluoro-n-propyl acrylate (that was a fluoro-containing acrylate monomer) and 50 parts of 1,1-dihydroperfluoro-n-propyl acrylate (that was also a fluoro-containing acrylate monomer) and 10% by weight of divinyl benzene (that was a cross-linking agent) were used.

Developer 2 of the invention was prepared in the same manner as in Example 1, except that the organic fine-particle A was replaced by organic fine-particle B.

<Example 3>

Organic fine-particle C having a primary average particle-size of 260 nm and a BET specific surface area of 33 $m^2/g$ was prepared in the same manner as in Example 1, except that a monomer mixture comprising 90% by weight of monomer component consisting of 70 parts of 1,1-dihydroperfluoro-n-propyl acrylate (that was a fluoro-containing acrylate monomer) and 30 parts of styrene (that was a copolymerizable monomer), and 10% by weight of ethylene glycol diacrylate (that was a cross-linking agent) were used.

Developer 3 of the invention was prepared in the same manner as in Example 1 except that the organic fine-particle A was replaced by organic fine-particle C.

<Example 4>

Organic fine-particle D having a primary average particle-size of 130 nm and a BET specific surface area of 42 $m^2/g$ was prepared in the same manner as in Example 1, except that a monomer mixture comprising 75% by weight of monomer component consisting of 60 parts of 1,1,1-trifluoroethyl methacrylate (that was a fluoro-containing acrylate monomer) and 40 parts of styrene (that was a copolymerizable monomer), and 25% by weight of divinyl benzene (that was a cross-linking agent) were used.

Developer 4 of the invention was prepared in the same manner as in Example 1, except that the organic fine-particle A was replaced by organic fine-particle D.

<Comparative Example 1>

Organic fine-particle a having a primary average particle-size of 160 nm and a BET specific surface area of 40 $m^2/g$ was prepared in the same manner as in Example 1, except that any cross-linking agent was not used.

Comparative developer 1 was prepared in the same manner as in Example 1, except that the organic fine-particle A was replaced by organic fine-particle a.

<Comparative Example 2>

Organic fine-particle b having a primary average particle-size of 135 nm and a BET specific surface area of 65 $m^2/g$ was prepared in the same manner as in Example 1, except that 1,1,1-trifluoroethyl methacrylate was replaced by styrene.

Comparative developer 2 was prepared in the same manner as in Example 1, except that the organic fine-particle A was replaced by organic fine-particle b.

<Example 5>

(1) Preparation of Toner

Toner added by organic fine-particle A was prepared in the same manner as in Example 1.

(2) Preparation of carrier

A coating solution was prepared by dissolving an ordinary temperature-setting reaction type methyl silicone resin in toluene. The resulting coating solution was coated on the surfaces of core-member particles (which were Cu-Zn ferrite particles having an average particle-size of 80 μm) and heated and then dried up to remove the solvent and to set the coated core-member particles, so that carrier (1) could be prepared.

(3) Preparation of developer

The resulting toner and carrier (1) were mixed up in such a proportion that the toner concentration could be 4% by weight, so that developer 5 of the invention could be prepared.

<Example 6>

(1) Preparation of toner

Toner added by organic fine-particle B was prepared in the same manner as in Example 2.

(2) Preparation of carrier

Carrier (1) was prepared in the same manner as in Example 5.

(3) Preparation of developer

The resulting toner and carrier (1) were mixed up in such a proportion that the toner concentration could be 4% by weight, so that developer 6 of the invention could be prepared.

<Example 7>

(1) Preparation of toner

Toner added by organic fine-particle C was prepared in the same manner as in Example 3.

(2) Preparation of carrier

A coating solution was prepared by dissolving 100 parts of ordinary temperature setting reaction type methyl silicone resin and 4 parts of amino-denatured silicone resin in toluene. The resulting coating solution was coated on the surfaces of core member particles (which were Cu-Zn ferrite particles having an average particle-size of 80 λm) and dried up by applying heat to remove the solvent and to set the coated particles, so that carrier (2) could be prepared.

(3) Preparation of developer

The resulting toner and carrier (2) were mixed up in such a proportion that the toner concentration could be 4% by weight, so that developer 7 of the invention could be prepared.

<Example 8>

(1) Preparation of toner

Organic fine-particle E was prepared in the same manner as in Example 4, except that styrene was replaced by methyl methacrylate for a copolymerizable monomer. Then, toner added by organic fine-particle E was prepared in the same manner as in Example 1, except that organic fine-particle A was replaced by organic fine-particle E.

(2) Preparation of carrier

Carrier (2) was prepared in the same manner as in Example 7.

(3) Preparation of developer

The resulting toner and carrier (2) were mixed up in such a proportion that the toner concentration could be 4% by weight, so that developer 8 of the invention could be prepared.

<Example 9>

(1) Preparation of toner

Toner added by organic fine-particle A was prepared in the same manner as in Example 1.

(2) Preparation of carrier

A coating solution was prepared by dissolving a styrene-methyl methacrylate resin in toluene. The resulting coating solution was coated on the surfaces of core member particles (which were Cu-Zn ferrite particles having an average particle-size of 80 μm) and dried by applying heat to removed the solvent and to set the coated particles, so that carrier (3) could be prepared.

(3) Preparation of developer

The resulting toner and carrier (3) were mixed up in such a proportion that the toner concentration could be 4% by weight, so that developer 9 of the invention could be prepared.

<Example 10>

(1) Preparation of toner

Toner added by organic fine-particle B was prepared in the same manner as in Example 2.

(2) Preparation of carrier

Carrier (3) was prepared in the same manner as in Example 9(3) Preparation of developer The resulting toner and carrier (3) were mixed up in such a proportion that the toner concentration could be 4% by weight, so that developer 10 of the invention could be prepared.

<Comparative Example 3>

(1) Preparation of toner

Toner added by organic fine-particle a was prepared in the same manner as in Comparative Example 1.

(2) Preparation of carrier

Carrier (1) was prepared in the same manner as in Example 5.

(3) Preparation of developer

The resulting toner and carrier (1) were mixed up in such a proportion that the toner concentration could be 4% by weight, so that comparative developer 3 could be prepared.

<Comparative Example 4>

(1) Preparation of toner

Toner added by organic fine-particle b was prepared in the same manner as in Comparative Example 2.

(2) Preparation of carrier

Carrier (1) was prepared in the same manner as in Example 5.

(3) Preparation of developer

The resulting toner and carrier (1) were mixed up in such a proportion that the toner concentration could be 4% by weight, so that comparative developer 4 could be prepared.

<Practical Photocopying Test>

With each of the resulting inventive developers 1 through 10 and comparative developers 1 through 4, 50,000 times practical photocopying tests were tried by making use of a recycling type electrophotographic copying machine, Model 5082 (manufactured by Konica Corp.) that is capable of recycling cleaning-toner to the developing unit. The evaluation was made on each of the following itemized results; the image-transfer ratios, image-transfer unevenness, stains produced inside the copying machine by tone-flying and presence of white streaks under the conditions of a high temperature and a high humidity (at 30° C. and 90%RH), and the image-densities under the conditions of a high temperature and a high humidity (at 30° C. and 90%RH) and under the conditions of a low temperature and a low humidity (at 10° C. and 20%RH), respectively.

In the tests, an image-transfer paper having a surface resistance of $8.5\times10^{8}\Omega$ (at 20° C. and 65%RH) according to JIS K 6911 was used as the image-transfer material.

The evaluation procedures for each item were as follows.

(1) Image-transfer ratio

After completing a 50,000 times image-formation, an image-transfer ratio was obtained in the following manner. An over-all solid toner image having a size of 20 mm×50 mm was formed on a photoreceptor. Before the resulting toner image was put in an image-transfer step, the toner image was picked up by making use of an adhesive tape, so that the toner weight $w_1$ measured. The same over-all solid toner image as that mentioned above was formed on a photoreceptor. The resulting toner image was put in an image-transfer step and was then transferred to an image-transfer paper. After completing the image-transfer, weight $w_2$ of the toner remaining on the photoreceptor was measured. From the toner weights $w_1$ and $w_2$ measured in such a manner as mentioned above, an image-transfer ratio was obtained in accordance with the following formula;

Image-transfer ratio $=(w_1-w_2)/w_1\times 100$ (%)

(2) Image-transfer unevenness

From an original document formed of a gray chart having an image density of 0.50, the copied image thereof was formed. With the resulting copied image, the presence of image-transfer unevenness produced thereon was visually observed.

(3) Stain produced inside a copying machine

Every time when carrying out a series of 1,000 times image formation, the inside of the copying machine was visually observed. The evaluation was made on the numbers of images copied when observing any stains produced therein of such an order that a practical problem was raised.

(4) White streak

From an original document formed of a gray chart having an image density of 0.50, the copied image thereof was formed. With the resulting copied image, the presence of white streaks produced thereon was visually observed. The evaluation was made on the numbers of images copied when observing any white streaks produced thereon of such an order that a practical problem was raised.

(5) Image density

From an original document formed of a chart having an image density of 0.50, the image density of the resulting copied image thereof was measured. It means that the more the resulting image density is closer to 0.50, the more the fidelity image density can be reproduced.

The results of the evaluation will be shown in the following Tables 1 and 2.

TABLE 1

| | | Organic fine-particle | | | | | | | Copied image density | |
|---|---|---|---|---|---|---|---|---|---|---|
| | Developer | Kind | Primary particle-size (nm) | BET specific surface area ($m^2/g$) | Image-transfer ratio (%) | Image-transfer unevenness | Machine stained inside (time) | White streak (time) | Under a high temp. & a high humidity condition | Under a low temp. & a low humidity condition |
| Example 1 | 1 | A | 90 | 106 | 91 | Not produced | Not produced | Not produced | 0.55 | 0.52 |
| Example 2 | 2 | B | 120 | 55 | 92 | Not produced | Not produced | Not produced | 0.54 | 0.51 |
| Example 3 | 3 | C | 260 | 33 | 91 | Not produced | Not produced | Not produced | 0.56 | 0.51 |
| Example 4 | 4 | D | 130 | 42 | 91 | Not produced | Not produced | Not produced | 0.54 | 0.51 |
| Comparative example 1 | Comparison 1 | a | 160 | 40 | 78 | 40000 times | 20000 times | 30000 times | 0.53 | 0.52 |
| Comparative example 2 | Comparison 2 | b | 136 | 65 | 76 | 20000 times | 35000 times | 40000 times | 0.88 | 0.54 |

TABLE 2

| | | Organic fine-particle | | | | | | | | Copied image density | |
|---|---|---|---|---|---|---|---|---|---|---|---|
| | Developer | Kind | Primary particle-size (nm) | BET specific surface area ($m^2/g$) | Carrier | Image-transfer ratio (%) | Image-transfer unevenness | Machine stained inside (time) | White streak (time) | Under a high temp. & a high humidity condition | Under a low temp. & a low humidity condition |
| Example 5 | 5 | A | 90 | 106 | (1) | 94 | Not produced | Not produced | Not produced | 0.54 | 0.51 |
| Example 6 | 6 | B | 120 | 55 | (1) | 93 | Not produced | Not produced | Not produced | 0.53 | 0.51 |
| Example 7 | 7 | C | 260 | 33 | (2) | 93 | Not produced | Not produced | Not produced | 0.51 | 0.50 |
| Example 8 | 8 | E | 130 | 42 | (2) | 94 | Not produced | Not produced | Not produced | 0.52 | 0.51 |
| Example 9 | 9 | A | 90 | 106 | (3) | 91 | Not produced | Not produced | Not produced | 0.54 | 0.54 |
| Example 10 | 10 | B | 120 | 55 | (3) | 91 | Not produced | Not produced | Not produced | 0.55 | 0.55 |
| Comparative example 3 | Comparison 3 | a | 160 | 40 | (1) | 81 | 40000 times | 20000 times | 30000 times | 0.54 | 0.51 |
| Comparative example 4 | Comparison 4 | b | 135 | 65 | (1) | 79 | 20000 times | 20000 times | 40000 times | 1.01 | 0.55 |

As are obvious from the results shown in Tables 1 and 2, developers 1 to 10 each of the invention are high in image-transfer ratio, none of any image-transfer unevenness and excellent in image-transfer characteristics. In addition, according to the developers of the invention, no stain inside a copying machine nor white streak can be produced even when image-copying 50000 times, so that multiple image-formation can stably be performed.

With the developers (particularly including developers 5 through 8 of the invention containing resin-coated carriers each comprising a silicone resin), an image-density having a fidelity can be reproduced even under a high-temperature and high-humidity environment and a low-temperature and low-humidity environment, either.

In contrast to the above, in comparative developers 1 and 3, contain each organic fine-particles not having any cross-linked structure are contained and, in comparative developers 2 and 4, the organic fine-particles thereof are comprised of a cross-linked resin not containing fluorine. At the practical tests, therefore, the inside of a copying machine is stained and a white streak is produced, so that multiple image-formation cannot stably be performed.

What is claimed is:

1. A developer comprising a toner containing colorant particles and organic fine particles which are externally added to said colorant particles, wherein said organic fine particles are a fluoro-containing acrylate homopolymer or a copolymer thereof, each having a cross-linked structure.

2. The developer of claim 1, wherein said organic fine particles have each a primary average particle-size within the range of 50 to 500 nm and a BET specific surface-area within the range of 10 to 120 $m^2/g$.

3. The developer of claim 1, wherein said fluoroacrylate type homopolymer and said fluoro-containing acrylate copolymer each comprises a fluoroacrylate repeating unit represented by Formula 1:

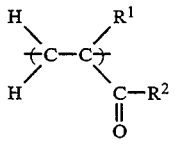

Formula 1 wherein $R^1$ represents a hydrogen atom or a methyl group; $R^2$ represents a residual group formed from an alcohol compound provided that a hydrogen atom is split off from a hydroxyl group of the alcohol compound comprising an alkyl group, wherein at least one of hydrogen atoms of the alkyl group is substituted at a fluorine atom.

4. The developer of claim 3, wherein the content of said fluoro-containing acrylate repeating unit is not less than 55% by weight of said fluoro-containing acrylate copolymer.

5. The developer of claim 1, wherein the toner is used as a two component type developer by being mixed with a carrier having a resin-coated layer comprising a silicone resin on the surfaces of magnetic particles.

6. The developer of claim 5, wherein said magnetic particles are selected from iron, a ferrite and magnetite.

7. The developer of claim 5, wherein said silicone resin is room temperature hardening reaction type silicone resin.

8. The developer of claim 2, wherein the toner is used as a two component type developer by being mixed with a carrier having a resin-coated layer comprising a silicone resin on the surfaces of magnetic particles.

9. The developer of claim 8, wherein said magnetic particles are selected from iron, a ferrite and magnetite.

10. The developer of claim 8, wherein said silicone resin is room temperature hardening reaction type silicone resin.

* * * * *

UNITED STATES PATENT AND TRADEMARK OFFICE

CERTIFICATE OF CORRECTION

PATENT NO. : 5,445,910

DATED : August 29, 1995

INVENTOR(S) : Michiaki ISHIKAWA et al.

It is certified that error appears in the above-indentified patent and that said Letters Patent is hereby corrected as shown below:

Item [57]

Abstract, line 1, "comprises" should read --comprising--.

line 3, "fine-particles" should read --fine particles--.

Signed and Sealed this

Eighteenth Day of June, 1996

*Attest:*

BRUCE LEHMAN

*Attesting Officer*

*Commissioner of Patents and Trademarks*